US005090621A

United States Patent [19]

McMillen et al.

[11] Patent Number: 5,090,621

[45] Date of Patent: Feb. 25, 1992

[54] CONSTANT DRIVE NOZZLE FOR IMPULSE IRRIGATION SPRINKLERS

[75] Inventors: Charles A. McMillen, Alta Loma; Hans D. Christen, La Verne, both of Calif.

[73] Assignee: Rain Bird Sprinkler Mfg. Corp., Glendora, Calif.

[21] Appl. No.: 634,022

[22] Filed: Dec. 26, 1990

[51] Int. Cl.[5] ..... B05B 3/02

[52] U.S. Cl. ..... 239/230; 239/233; 239/552; 239/601

[58] Field of Search ..... 239/230, 233, 246, 552, 239/601

[56] References Cited

U.S. PATENT DOCUMENTS

| | | | |
|---|---|---|---|
| 2,345,030 | 3/1944 | Buckner | 239/233 |
| 2,792,256 | 5/1957 | Sinex | 239/233 |
| 3,080,123 | 3/1963 | Erns | 239/601 X |
| 3,779,462 | 12/1973 | Bruninga | 239/230 |
| 3,799,453 | 3/1974 | Hart | 239/233 X |
| 3,924,809 | 12/1975 | Troup | 239/230 |
| 4,195,782 | 4/1980 | Troup | 239/230 |
| 4,330,087 | 5/1982 | Wood et al. | 239/233 |
| 4,498,626 | 2/1985 | Pitchford | 239/230 |
| 4,754,925 | 7/1988 | Rubinstein | 239/230 |

FOREIGN PATENT DOCUMENTS

| | | | |
|---|---|---|---|
| 500789 | 11/1954 | Italy | 239/230 |
| 1421275 | 9/1988 | U.S.S.R. | 239/230 |

*Primary Examiner*—Andres Kashnikow
*Assistant Examiner*—William Grant
*Attorney, Agent, or Firm*—Kelly, Bauersfeld & Lowry

[57] ABSTRACT

A constant drive nozzle for use in combination with an impulse or impact drive sprinkler includes a tubular nozzle body with a drive orifice and a range orifice formed in its outlet end. The stream issuing from the nozzle is formed into a drive stream portion and a range stream portion by the drive and range orifices. Since only the drive stream portion intercepts the drive spoon of the arm which impacts and rotates the sprinkler body, various diameter range orifices can be used in conjunction with a single diameter drive orifice without affecting the rotational speed of the sprinkler body.

15 Claims, 3 Drawing Sheets

FIG. 1
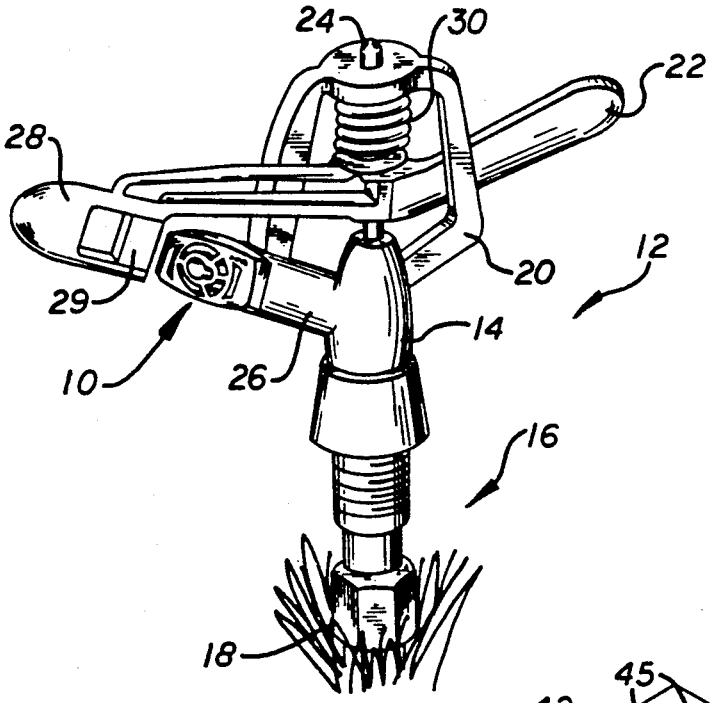
FIG. 2
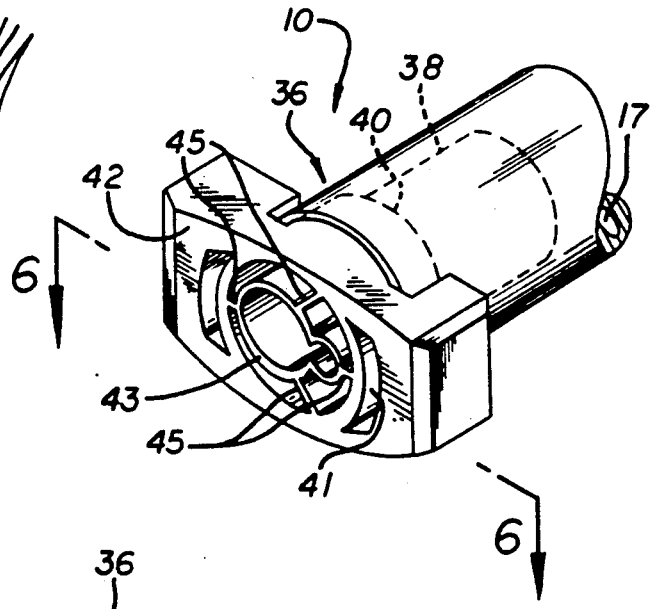
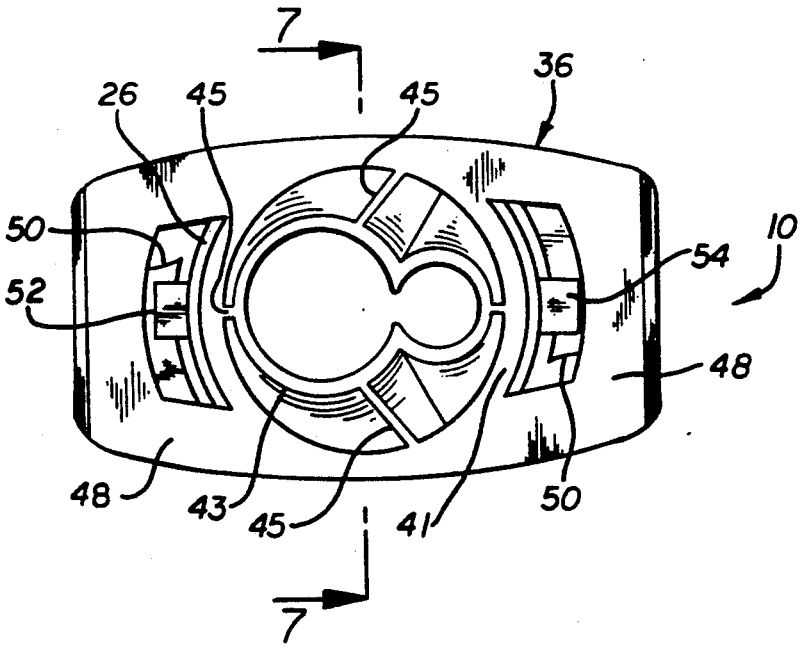
FIG. 3

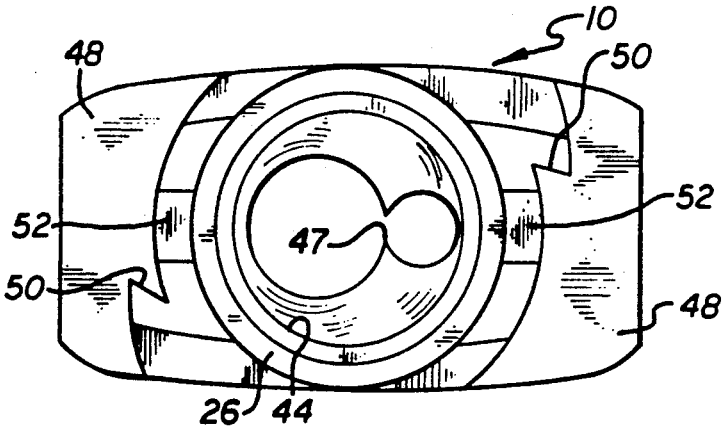
FIG. 4
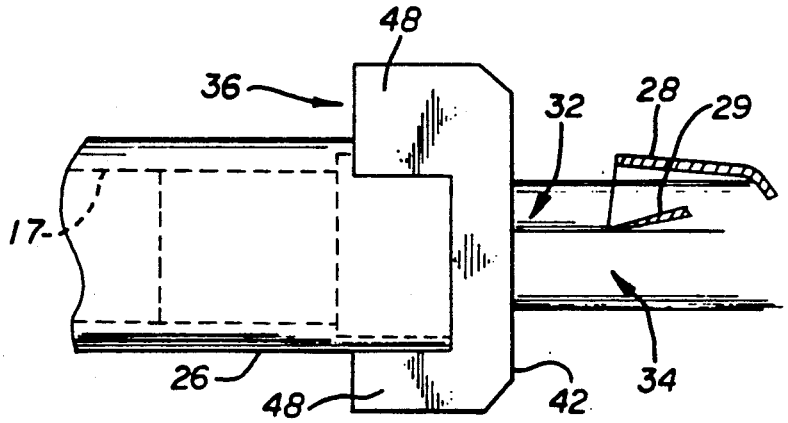
FIG. 5
FIG. 6
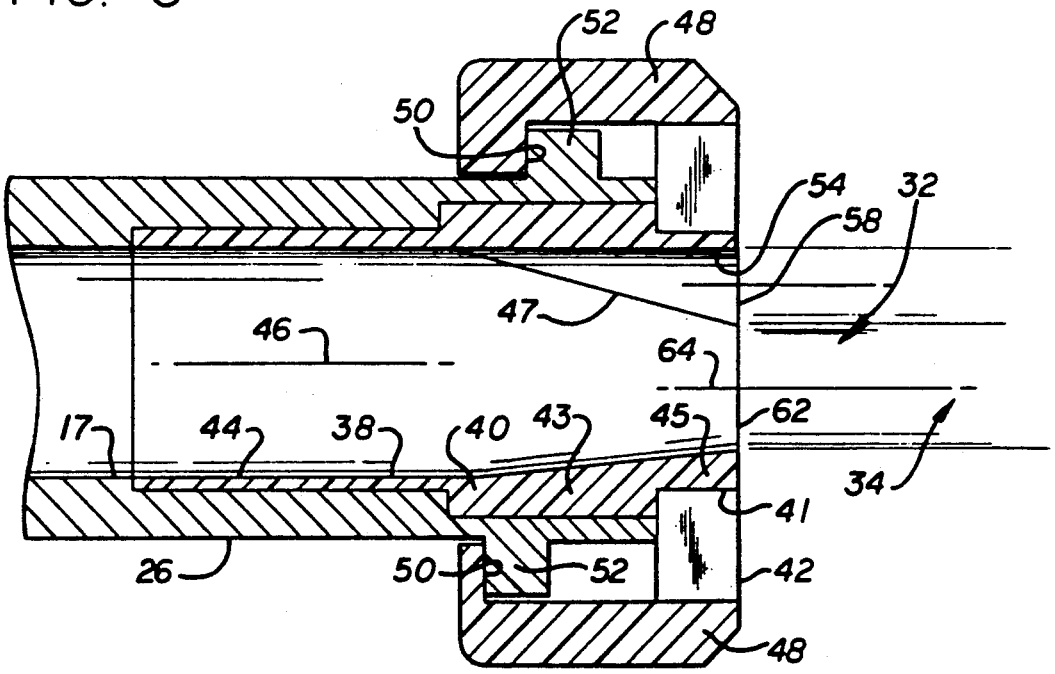

CONSTANT DRIVE NOZZLE FOR IMPULSE IRRIGATION SPRINKLERS

BACKGROUND OF THE INVENTION

This invention relates generally to impact or impulse drive type irrigation sprinklers, and more sprinklers which insures that a constant drive force is maintained regardless of nozzle size.

Impulse or impact drive type sprinklers (hereinafter referred to as "impulse type sprinklers") have long been used int he irrigation arts for the watering of crops, lawns, trees, shrubs, and the like. Such sprinklers typically comprise a sprinkler body mounted for rotation on a riser coupled to a suitable source of pressurized water, upwardly and outwardly away from the sprinkler body. The sprinkler body carries a spring biased osciallating drive arm having a drive spoon at one end which effects rotation of the sprinkler body by repeatedly oscillating into and out of the stream from the sprinkler nozzle. As the drive spoon intercepts the stream from the sprinkler nozzle, the stream is deflected laterally creating a torsional force on the drive arm to rotate the spoon out of and away from the stream. The drive spoon is then returned to the stream by an arm spring coupled between the drive arm and the sprinkler body, and upon re-entering the stream, the drive arm impacts against the sprinkler body causing an incremental rotation of the body about the supply riser.

One problem which has long been recognized in the impulse type sprinkler art is that of erratic and non-uniform oscillation of the drive arm caused by the use of various sized sprinkler nozzles. Most impulse type sprinklers typically are designed for use with a variety of nozzle sizes, the nozzles being changeable to permit the user to vary the water application rate and area covered to suit the particular needs. Each different size nozzle, however, produces a different flow and thus imparts a different force to the drive spoon, thereby resulting in variations in the speed of drive arm oscillation and, consequently, the speed of rotation of the sprinkler body.

Various attempts have been made to overcome this problem, typically by altering the geometry of the drive spoon so that only a constant size segment of the stream from any given nozzle is intercepted. Exemplary of such an attempt is that disclosed in U.S. Pat. No. 3,726,479, assigned to the assignee of the present application, and which proposes a specially designed drive spoon having a deflector portion modified so that only a substantially constant size segment of the stream from any given nozzle will be used to drive the sprinkler. While use of specially designed drive spoons such as suggested in the foregoing patent have met with considerable success, the range of nozzle sizes usable has still been limited since oversized nozzles may still impart excessive force to the deflector portion of the spoon.

Another problem raised by the use of various size nozzles with impulse type sprinklers is that of the possibility of reverse rotation of the sprinkler body caused by excessive drive force when a sprinkler nozzle larger than that for which the sprinkler was designed is used. When such an oversized sprinkler nozzle is used, the drive arm may actually be driven out of the stream with such great force as to cause the arm to impact against the sprinkler body in the opposite direction, thereby producing an incremental reverse rotation. One attempt to overcome this problem is disclosed in U.S. Pat. No. 4,055,304, also assigned to the assignee of the present application, and which suggests the use of a secondary arm spring operable when the impact arm rotates in excess of a predetermined arc due to excessive rotational force being applied to the drive spoon.

While each of the foregoing attempts at solving the problems of erratic and uneven sprinkler rotation have met with some degree of success, there still exists a need for device which permits an impulse type sprinkler to be capable of use with a wide variety of nozzle sizes, but which rotates in a constant and predictable manner. As will become more apparent hereinafter, the present invention fulfills that need in a novel and unobvious manner.

SUMMARY OF THE INVENTION

The present invention provides a new and improved nozzle for use with impulse type irrigation sprinklers which insures that a constant and predictable drive force is always applied to the sprinkler drive arm even though a wide variety of nozzle sizes are used. Moreover, the nozzle of the present invention is relatively simple in design and inexpensive to manufacture, is substantially clog free, and permits a given impulse type sprinkler to be operated reliably and effectively for a wider range of flow rates and areas covered then heretofore possible.

More particularly, the nozzle of the present invention is specifically designed and constructed to produce a drive stream portion of preselected and constant size for driving the sprinkler, and a range stream portion whose size may be varied over exceptionally wide ranges without adversely affecting or changing the drive characteristics of the sprinkler. The nozzle includes a nozzle body having a nozzle inlet section having a passageway adapted to mate with the water passageway through the sprinkler body, and a nozzle section having an outlet end containing a drive orifice of preselected and constant size, and a range orifice laterally displaced from the drive orifice and which size may be varied over wide limits.

In the preferred form of the invention, the drive orifice communicates with the inlet section through a cylindrical passage laterally off-set from the centerline of the nozzle, the drive orifice and passage being formed to have a diameter approximately equal to the diameter of the smallest size nozzle recommended for use with the particular sprinkler. The range orifice communicates with the inlet section through a uniformly converging passage having its largest diameter equal to the diameter of the passageway of the inlet section and the smallest diameter at the range orifice.

By coupling the nozzle body to the sprinkler so that the sprinkler drive spoon will only intercept and engage the stream from the drive orifice, a constant drive force will be imparted to the drive spoon regardless of the size of the range orifice. By laterally displacing the range orifice from the drive orifice such that they are tangent but do not overlap, separate drive and range streams portions can be formed and the range stream portion will not interfere with the drive function of the drive stream portion. Since the drive orifice, and hence the drive stream portion, is of a fixed size for all range orifice sizes, the range orifice size, and hence the size of the range stream portion, can be varied over wide limits to produce total nozzle flow rates substantially higher than heretofore possible for any given sprinkler.

The many features and advantages of the present invention will become more apparent from the following detailed description and accompanying drawings which disclosed, by way of example, the principles of the present invention.

BRIEF DESCRIPTION OF THE DRAWINGS

FIG. 1 is a perspective view of an impulse drive type sprinkler having a constant drive nozzle made in accordance with the principles of the present invention coupled thereto;

FIG. 2 is an enlarged fragmentary perspective view of the constant drive nozzle of FIG. 1;

FIG. 3 is an enlarged front elevational view of the nozzle of FIG. 2;

FIG. 4 is a rear elevational view of the nozzle of FIG. 3;

FIG. 5 is a fragmentary top plan view of the nozzle of FIG. 2 showing the water flow therefrom and the location of the sprinkler drive spoon in the fully engaged position;

FIG. 6 is a cross-sectional view of the nozzle of FIG. 2 taken substantially along line 6—6 thereof and slowing the water flow therethrough;

DETAILED DESCRIPTION OF THE PRESENTLY PREFERRED EMBODIMENT

Figure 7:
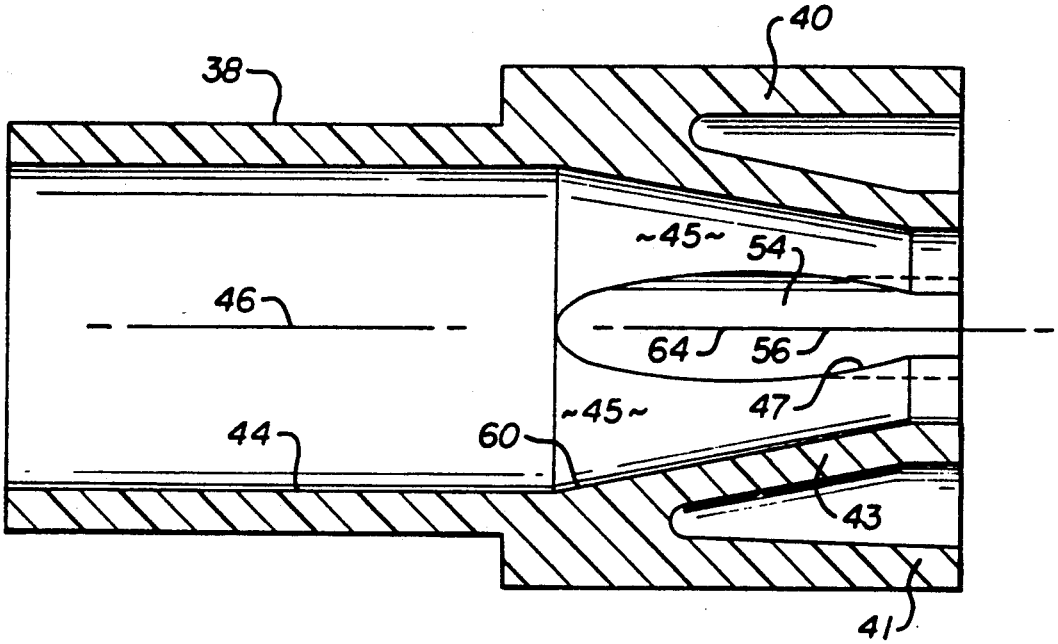
FIG. 7 is a cross-sectional view taken substantially along the line 7—7 of FIG. 3.

As shown in the exemplary drawings, the present invention is embodied in a new and improved nozzle 10 for use with impulse drive type irrigation sprinklers 12. In this instance, the sprinkler 12 is of conventional design and includes a body 14 mounted for rotation about a generally vertical axis through a nipple and journal bearing assembly, generally designated 16, to the upper end of a tubular supply conduit or riser 18 through which pressurized water is supplied to the sprinkler, an internal water passageway 17 being formed inside the body for directing water from the riser to the nozzle 10. Integrally formed with the body 14 is an inverted U-shaped bridge 20 supporting a drive arm 22 for rotation about the vertical axis relative to the body, the drive arm herein being supported by a pivot pin 24 extending between the body and the bridge.

The nozzle 10 is removably mounted to a tubular outlet portion 26 of the sprinkler body 14, and is disposed to eject water outwardly and upwardly from the body. Formed on one end of the drive arm 22 is a drive spoon 28 of conventional design, and which is disposed to intercept a portion of the stream from the nozzle 10, as will be more fully discussed hereinafter. To absorb the energy of the swinging drive arm 22 and return the drive spoon 28 toward the stream from the nozzle 10, an arm spring 30 is coupled between the drive arm and the bridge 20 about the pivot pin 24, and is mounted with a suitable pre-load biasing the drive spoon into the stream intercepting position.

In operation of the sprinkler 12, water from the nozzle 10 intercepted by the drive spoon 28 is deflected laterally and produces a torque on the drive arm 22 tending to swing the drive arm, herein in a counter clockwise direction as shown in FIG. 1, away from the nozzle against the bias of the arm spring 30. As the drive arm 22 swings away from the nozzle 10, energy is absorbed and stored in the arm spring 30 until the energy of the drive arm is dissipated, at which point the arm spring swings the drive arm back in the opposite direction toward the nozzle 10. As the drive spoon 28 again intercepts the stream from the nozzle 10, the drive arm 22 impacts against the bridge 20 causing an incremental rotation of the body about the riser 18. Typically, the drive spoon 28 includes a leading edge vane 29 which functions to help pull the spoon into the water stream from the nozzle as the drive spoon initially engages the stream, thereby to effect a solid impact of the drive arm 22 against the bridge 20 for producing an incremental forward rotation of the sprinkler body 14. Repeated oscillations of the drive arm 22 thus cause the sprinkler 12 to rotate in a clockwise direction about the riser 18.

The arcuate extent of the swing of the drive arm 22 away from the nozzle stream is a function of the amount of energy imparted to the drive arm each time the drive spoon 28 intercepts the stream from the nozzle 10. The amount of energy imparted to the drive spoon 28 is, in turn, a function of the stream pressure and stream size. For any given supply pressure, if the size of the nozzle is increased, a larger stream and flow rate is produced, thereby increasing the amount of energy imparted to the drive arm 22. The greater the amount of energy, the faster the drive arm 22 will oscillate so that with a typical nozzle, as the size of the nozzle is increased, the speed of rotation of the sprinkler correspondingly will increase. In the event that a nozzle size larger than that for which the sprinkler 12 was designed is used, the drive arm 22 may actually swing so far as to impact against the bridge 20 on the opposite side, thereby causing the sprinkler body 14 to turn incrementally in the wrong direction. Further, higher sprinkler rotational speeds caused by the use of larger size nozzles reduce the distance water is thrown from the sprinkler 12 and adversely affect the water distribution pattern.

It is, therefore, desirable to attempt to match the nozzle size to the water supply pressures over which the sprinkler 12 is to be operated to control the rate of drive arm swing so that all of the sprinklers of a given size and type in a system rotate at approximately the same speed. For this reason, sprinkler manufacturers normally provide a variety of different size sprinklers, typically ½ inch, ¾ inch, 1 inch and larger, each designed to be used with a limited range of nozzle sizes for producing a range of flow rates at various water supply pressures. Typically, for producing higher flow rates, larger size sprinklers capable of operating with larger diameter nozzles are required, and in some instances, modifications in the sprinkler drive spoon 28 such as disclosed in U.S. Pat. No. 3,726,479 may have been used. To achieve very high flow rates in comparatively smaller size sprinklers, sprinklers having two nozzles, one designed to drive the sprinkler 12 and the other to project a separate stream which is not intercepted by the drive spoon 28 have been required. The use of multi-nozzle sprinklers, however, typically is limited to only full circle sprinklers since the separate uninterrupted stream normally is ejected through a nozzle disposed on the rear of the sprinkler body opposite the drive nozzle.

In accordance with the present invention, the nozzle 10 is designed and constructed as a single nozzle unit which produces a drive stream portion, designated 32 in FIGS. 5 and 6, of preselected and constant size which is always intercepted by the drive spoon 28, and a range stream portion, designated 34, of variable size which does not impinge on the drive spoon. By employing a constant size drive stream portion 32, the nozzle 10 permits a wide variety of water flow rates to be used with any given sprinkler without affecting the speed of rotation of the sprinkler 12, and insures that the sprinkler will reliably operate with a substantially constant speed of rotation over a very wide range of water supply pressures without requiring any special drive spoon configurations or sprinkler modifications. Moreover, by integrating into a single nozzle 10 both a drive stream portion 32 and a range stream portion 34, the nozzle of the invention allows a smaller size sprinkler 12 to be used for irrigating larger areas than heretofore possible with conventional nozzle designs and does not limit the sprinkler to only full circle use.

Toward the foregoing ends, the nozzle 10, which preferably is formed of molded plastic, has a tubular body 36 adapted to be releasably coupled to the outlet portion 26 of the sprinkler 12, herein by a bayonet type connection of generally conventional design which not only secures the nozzle to the sprinkler, but also insures that the nozzle is properly oriented with respect to the sprinkler drive spoon 28. As seen in FIGS. 2 and 6, the nozzle body 36 has a cylindrical inlet section 38 adapted to be received within the sprinkler outlet portion 26, and a nozzle section 40 having an outlet end 42 from which the water is ejected from the nozzle. The inlet section 38 herein is formed to have a cylindrical passage 44 of constant diameter forming an extension of the internal water passageway of the sprinkler, and the axis of the cylindrical passage through the inlet section defines a centerline 46 of the nozzle 10. In this instance, the nozzle section 40 has an outer cylindrical portion 41 formed as an enlarged diameter extension of the inlet section 38, and which supports a forwardly converging inner tubular portion 43 within which the water outlet passage from the nozzle body 36 is formed. As will become more apparent hereinafter, the inner tubular portion 43 may have various sizes, depending upon the overall water flow rate desired for the nozzle 10, and is supported within the outer cylindrical portion 41 by a plurality of wedge shaped support ribs 45 extending therebetween.

As best seen in FIGS. 3, 4 and 6, the bayonet connection for coupling the nozzle 10 to the sprinkler body 12 herein includes a pair of diametrically opposed flanges 48 projecting radially outwardly from the nozzle section 40 of the nozzle body 36, and which are provided with cam surfaces 50 adapted to frictionally engage and wedge against the sides of corresponding radial abutment ears 52 projecting outwardly from diametrically opposed sides of the outlet portion 26 of the sprinkler body 14. To couple the nozzle 10 to the sprinkler 12, the inlet section 38 is inserted into the internal water passageway of the outlet portion 26 of the sprinkler body 14, and the nozzle body 36 is rotated to bring the cam surfaces 56 into wedging engagement with the abutment ears 52, thereby locking the nozzle onto the sprinkler.

Preferably, to insure that the nozzle 10 is properly oriented with respect to the drive spoon 28 of the sprinkler 12 so that the drive stream portion 32 is in a position to be intercepted by the drive spoon, one pair of the mating cam surfaces 50 and abutment ears 52 is herein formed to be axially displaced relative to the other pair (see FIG. 6) so that the nozzle can only be locked to the sprinkler in one position. In this respect, it should be noted that the sprinkler body 14 should be constructed such that the drive spoon 28 can move fully into the drive stream portion 32 prior to impact of the drive arm 22, but not far enough to cross the drive stream portion and intercept the range stream portion 34.

As best seen in FIGS. 5, 6 and 7, the drive stream portion 32 of the nozzle 10 is formed by a cylindrical drive passage 54 of constant diameter terminating in a circular outlet or drive orifice 58 formed on an axis 56 disposed to be parallel with the centerline 46 of the nozzle, but laterally displaced to the side of the nozzle adjacent the drive spoon 28. In the preferred form of the invention, the circular drive orifice 58 has a diameter equal to that of the smallest diameter nozzle for which the particular sprinkler 12 is recommended for use, and is disposed to have its laterally outer peripheral wall coincident with the wall defining the cylindrical passage 44 so as to effectively form a straight bore nozzle passage between the inlet section 38 and the outlet end 42 of the nozzle section 40. For example, for a Model S20H—½ inch type sprinkler sold by Rain Bird Sprinkler Mfg. Corp. of Glendora, California, as shown in its 1990 Agricultural Irrigation Equipment catalogue at page 21, the smallest diameter nozzle recommended is a 3/32 inch diameter nozzle, and the drive orifice 58 of the drive passage 54 for the nozzle 10 of the present invention should be formed to have a 3/32 inch diameter. Similarly, for a Rain Bird Model 30WH—¾ inch type sprinkler, as shown at page 27 of the same catalogue, the smallest diameter nozzle recommended is a 9/64 inch nozzle, and the drive orifice 58 for the nozzle 10 should therefore be formed to have a 9/64 inch diameter. Forming the drive orifice 58 of the drive passage 54 to always have the same size as the smallest diameter nozzle for which any particular sprinkler 12 is designed will insure that the sprinkler will always drive at the same rotational speed for each given water supply pressure.

Figure 8:
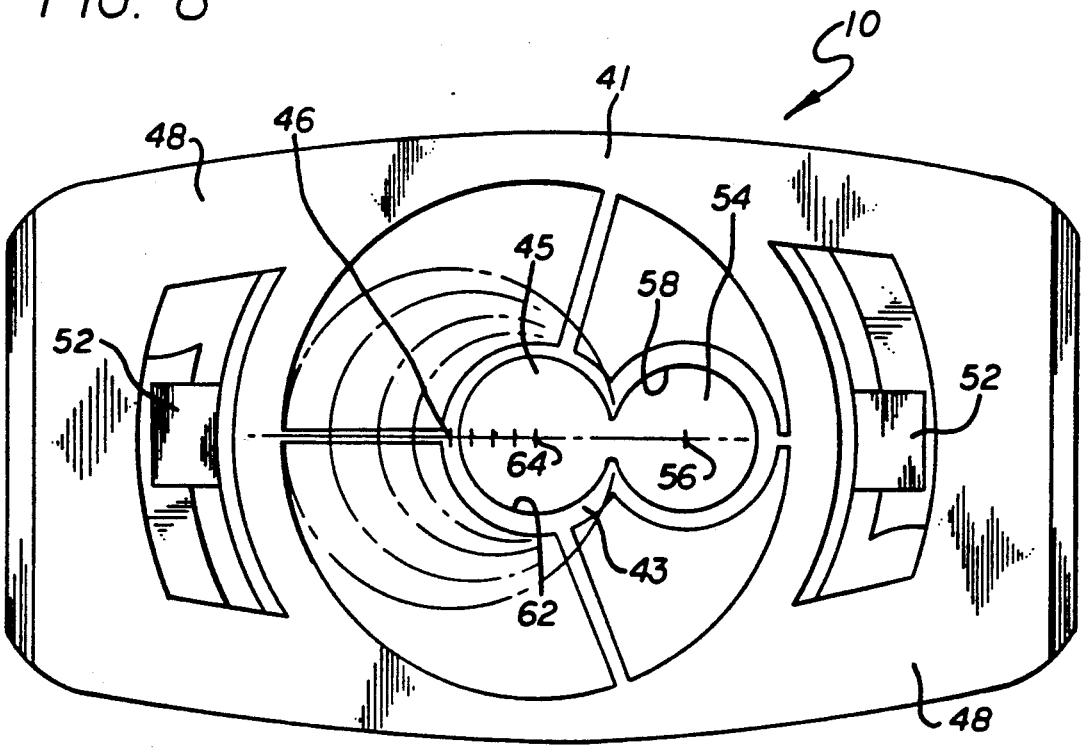
FIG. 8 is an enlarged front end elevational view of a nozzle made in accordance with the invention and showing broken line representations of various sized range orifice openings.

As best seen in FIGS. 4 and 8, the range stream portion 34 is produced by forming the inner tubular portion 43 of the nozzle section 40 to be a uniformly converging passageway 45 extending to an outlet or range orifice 62 located at the outlet end 42 of the nozzle section. Herein, the range orifice 62 is formed to have an axis 64 which lies in a lateral plane extending through the centerline 46 of the nozzle 10 and the axis 56 of the drive orifice 58, and the axis 64 of the range orifice is displaced laterally of the axis 56 of the drive orifice in the direction of the centerline of the nozzle such that the adjacent perimeters of the drive orifice and the range orifice are approximately tangent to one another and not overlapping.

The passageway 45 for the range stream portion 34 through the nozzle section 40 thus extends from the terminus of the inlet section 38 to the range orifice 62 and has a generally truncated conical configuration with a constantly converging circular lateral cross-section, the largest diameter of which is defined by the nozzle centerline 46 at the junction of the inlet and nozzle sections, and the smallest diameter of which is defined by the axis 64 of the range orifice. By forming the range orifice 62 to be tangent to the drive orifice 58, each orifice will produce a separate stream with only the stream from the drive orifice being intercepted by the drive spoon 28. Further, forming the drive and range orifices 58 and 62 to be tangent to one another allows the nozzle 10 to be molded with out requiring a dividing wall between the two outlets which could form a barrier to particulate matter entrained in the water supply and thus clog the nozzle. In this regard, since the passageway 45 to the range orifice 62 is converging, and the drive passage 54 is cylindrical, a wall 47 is formed separating the two except in the immediate area of intersection. Thus there will be a small segment of the nozzle passage which is always open between the drive passage 54 and the range passageway 45 through which particulate material can be passed.

Importantly, the cross-sectional area of the range orifice 62 can be formed to have a wide variety of sizes, typically from an area approximately equal to that of the drive orifice 58, to an area approximately equal to the cross-sectional area of the cylindrical passage 44 of the inlet section 38, minus the area of the drive orifice 58. That is, the combined areas of the range orifice 62 and the drive orifice 58 are limited to the cross-sectional area of the water passageway through the sprinkler outlet portion 26. In this respect, attention is directed to FIG. 8 which illustrates the nozzle 10 of the present invention with a solid line representation of a range orifice 62 having a size approximately equal to the size of the drive orifice 58, and in broken lines, various larger range orifice sizes up to the largest permitted by the size of the nozzle section 40.

By forming the range orifice 62 such that it does not overlap with the drive orifice 58, regardless of the size of the range stream portion 34, the range stream portion will not be intercepted by the drive spoon 28 of the sprinkler 12, and the energy imparted to the drive arm 22 will remain substantially constant. This permits larger sized nozzles to be reliably and effectively used on smaller size sprinklers, thereby permitting a user to simply select a nozzle having a large diameter range orifice to obtain higher flow rates, rather than having to purchase a new more expensive larger sprinkler. For example, in a test of the subject nozzle 10 on a Rain Bird Model S20—½ inch sprinkler, which has a 5/16 inch diameter circular passageway through the sprinkler body operated at a supply pressure of 60 pounds per square inch, it was found that a flow rate of 11.5 gallons per minute could be achieved using a 3/32 inch diameter drive orifice 58, and a maximum sized range orifice 62 having a diameter of approximately 7/32 inch. Normally, such a sprinkler using a conventional 9/64 inch diameter nozzle, the largest nozzle diameter recommended for use on that sprinkler, will only produce a flow rate of 4.4 gallons per minute when operated a 60 pounds per square inch supply pressure. To achieve an 11.5 gallon per minute flow rate with a 60 pounds per square inch supply pressure would typically require use of a larger, more expensive ¾ inch sprinkler such as the Rain Bird Model 30H two nozzle sprinkler using a 3/16 inch diameter straight bore drive nozzle and a ⅛ inch diameter rear spreader nozzle. Thus, the nozzle 10 of the present invention allows a smaller, less expensive sprinkler 12 to be reliably and effectively operated over a much greater range of flow rates than was heretofore possible, and, since the drive stream portion 32 is the only portion of the total flow driving the sprinkler, the sprinkler will rotate at its optimum speed for producing the most desirable water distribution pattern and greatest range.

While the preceding discussion has been directed to the use of a range orifice 62 having a circular cross-section, it should be noted that the range orifice can be formed with different shapes and configurations so long as the range stream portion 34 produced does not interfere with the drive stream portion 32 or the operation of the drive spoon 28. For example, to control distribution of the water from the range stream portion 34, the range orifice 62 could be formed to have a star or square shaped configuration such as depicted at pages 14 and 26 of the Rain Bird 1990 Agricultural Irrigation Equipment catalogue.

From the foregoing, it should be appreciated that the present invention provides a new and improved constant drive nozzle 10 for use with impulse type irrigation sprinklers 12 which allows greater flow rates to be achieved than heretofore possible, and which is simple in design, inexpensive to manufacture, yet which is highly reliable and effective in use. It should also be apparent that various modifications and changes can be made to the specific embodiments disclosed with out departing from the spirit and scope of the invention as defined by the following claims.

We claim:

1. A constant drive nozzle for use in combination with an impulse or impact drive sprinkler of the type including a sprinkler body adapted to be rotatably coupled with a supply conduit providing a source of pressurized water and having an outlet portion to which a nozzle can be coupled for ejecting water outwardly from the sprinkler body, a passage through the sprinkler body for directing water from the supply conduit through the outlet portion, and an oscillating drive arm rotatably carried by the sprinkler body for effecting rotation of the sprinkler body about a generally vertical axis, the drive arm having a drive spoon adapted to intercept a portion of the water ejected from the nozzle in intercepting position and to be laterally deflected thereby out of the intercepting position, and means biasing the drive spoon back toward the intercepting position such that repeated oscillations of the drive arm effect rotation of the sprinkler body about the supply conduit, said constant drive nozzle comprising:

a tubular nozzle body having an inlet end and an outlet end, said inlet end including an inlet opening adapted to mate with and form a continuation of the water passage through the outlet portion of the sprinkler body, said inlet opening defining a nozzle centerline;

a circular drive orifice formed in said outlet end and defining a drive orifice axis, said circular drive orifice having a preselected size smaller than the size of said inlet opening, the axis of said drive orifice being laterally offset from said nozzle centerline;

a range orifice formed in said outlet end and defining a range orifice axis, said range orifice axis being disposed to be laterally spaced from said drive orifice axis in the direction of said nozzle centerline and lying in a plane extending through said centerline and said drive orifice axis such that said range orifice is tangent to said drive orifice, the size of said range orifice being at least approximately equal to or greater than the size of said drive orifice;

water passageway means communicating between said inlet end and each of said drive and range orifices, said passageway means being formed to cause water entering said inlet opening to be ejected from said nozzle body through both said drive orifice and said range orifice as substantially separate stream portions; and means for coupling and orienting said nozzle body to the outlet portion of the sprinkler body with said drive orifice adjacent the drive spoon such that when the drive spoon is in the intercepting position, only that portion of the water entering said inlet end which is ejected through said drive orifice will engage the drive spoon.

2. A constant drive nozzle as set forth in claim 1 wherein said water passageway means comprises a converging passageway extending from said inlet end toward said range orifice.

3. A constant drive nozzle as set forth in claim 2 wherein said range orifice has a circular shape.

4. A constant drive nozzle as set forth in claim 1 or 3 wherein said range orifice axis is disposed on the side of said nozzle centerline opposite said drive orifice axis.

5. A constant drive nozzle as set forth in claim 1 or 3 wherein said range orifice axis is coincident with said nozzle centerline.

6. A constant drive nozzle as set forth in claim 1 wherein said water passageway means comprises a converging passageway extending from said inlet end to said range orifice, and a cylindrical passageway extending from said inlet end to said drive orifice.

7. A constant drive nozzle as set forth in claim 6 wherein said cylindrical passageway intersects said converging passageway.

8. A constant drive nozzle as set forth in claim 7 wherein said converging passageway has a maximum diameter equal to the diameter of said inlet opening and converges uniformly toward said range orifice.

9. A constant drive nozzle for use in combination with an impulse or impact drive sprinkler of the type including a sprinkler body adapted to be rotatably coupled with a supply conduit providing a source of pressurized water and having an outlet portion to which a nozzle can be coupled for ejecting water outwardly from the sprinkler body, a water passage through the sprinkler body for directing water from the supply conduit through the outlet portion, and an oscillating drive arm rotatably carried by the sprinkler body for effecting rotation of the sprinkler body about a generally vertical axis, the drive arm having a drive spoon adapted to intercept a portion of the water ejected from the nozzle in an intercepting position and to be laterally deflected thereby out of the intercepting position, and means biasing the drive spoon back toward the intercepting position such that repeated oscillations of the drive arm effect rotation of the sprinkler body about the supply conduit, said constant drive nozzle comprising:

a tubular nozzle body having an inlet end and an outlet end and a water passageway means therethrough for communicating with the water passage through the outlet portion of the sprinkler body, said inlet end including an inlet opening defining a nozzle centerline;

means formed in said outlet end defining a drive orifice axis and a drive orifice communicating with said water passageway means for ejecting a stream of water of constant size from said nozzle body;

means formed in said outlet end defining a range orifice axis and a range orifice communicating with said water passageway means for ejecting a stream of water of a preselected size at least approximately equal to or greater than said constant size from said nozzle body, said range orifice being displaced relative to said drive orifice such that said stream ejected from said drive orifice is substantially separate from and tangent to said stream ejected from said range orifice; and means for coupling and orienting said nozzle body to said outlet portion of said sprinkler body with said drive orifice adjacent the drive spoon such that when the drive spoon is in the intercepting position, only said stream ejected by said drive orifice will engage said drive spoon.

10. A constant drive nozzle as set forth in claim 10 wherein said drive orifice and said range orifice are each circular in shape.

11. A constant drive nozzle as set forth in claim 10 wherein said water passageway means comprises a converging passageway extending from said inlet end to said range orifice and a cylindrical passageway extending from said inlet end to said drive orifice.

12. A constant drive nozzle as set forth in claim 11 wherein said cylindrical passageway intersects said converging passageway.

13. A constant drive nozzle as set forth in claim 12 wherein said converging passageway has a maximum diameter equal to the diameter of said inlet opening and converges uniformly toward said range orifice.

14. A constant drive nozzle as set forth in claim 13 wherein said range orifice axis is disposed on the side of said nozzle centerline opposite said drive orifice axis.

15. A constant drive nozzle as set forth in claim 13 wherein said range orifice axis is coincident with said nozzle centerline.

* * * * *

UNITED STATES PATENT AND TRADEMARK OFFICE

CERTIFICATE OF CORRECTION

PATENT NO. : 5,090,621

DATED : February 25, 1992

INVENTOR(S) : Charles A. McMillen and Hans D. Christen

It is certified that error appears in the above-identified patent and that said Letters Patent is hereby corrected as shown below:

In Column 1, line 7, after the word "more", insert -- particularly, to a new and improved nozzle for such--;

In Column 1, line 11, delete "int he", and insert --in the--;

In Column 1, line 15, after "water,", insert --and include a sprinkler nozzle for directing a water stream--;

In Column 1, line 17, delete "osciallating", and insert --oscillating--;

In Column 7, line 53, delete "3/8", and insert --1/8--.

In Column 10, Claim 10, line 27, delete "10" (second occurrence), and insert --9--.

Signed and Sealed this

Twenty-ninth Day of June, 1993

Attest:

Michael K. Kirk

MICHAEL K. KIRK

Attesting Officer

Acting Commissioner of Patents and Trademarks